US010851673B2

(12) United States Patent
Ham

(10) Patent No.: US 10,851,673 B2
(45) Date of Patent: Dec. 1, 2020

(54) TURBINE STATOR, TURBINE, AND GAS TURBINE INCLUDING THE SAME

(71) Applicant: DOOSAN HEAVY INDUSTRIES & CONSTRUCTION CO., LTD., Changwon-si (KR)

(72) Inventor: Dong Woo Ham, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 251 days.

(21) Appl. No.: 16/038,179

(22) Filed: Jul. 18, 2018

(65) Prior Publication Data

US 2019/0085727 A1 Mar. 21, 2019

(30) Foreign Application Priority Data

Sep. 20, 2017 (KR) ..... 10-2017-0121199

(51) Int. Cl.
*F01D 25/24* (2006.01)
*F01D 9/04* (2006.01)
*F01D 25/26* (2006.01)

(52) U.S. Cl.
CPC ..... *F01D 25/246* (2013.01); *F01D 9/042* (2013.01); *F01D 25/26* (2013.01); *F05D 2240/11* (2013.01); *F05D 2240/12* (2013.01); *F05D 2240/14* (2013.01); *F05D 2260/31* (2013.01)

(58) Field of Classification Search
CPC ..... F01D 25/246; F01D 5/3023; F01D 5/303; F01D 5/3038; F01D 5/3046; F01D 5/32; F01D 9/042; F01D 25/243; F01D 9/04
See application file for complete search history.

(56) References Cited

U.S. PATENT DOCUMENTS 3,141,651 A * 7/1964 Moyer ..... F01D 25/26 415/136
3,147,952 A * 9/1964 Ladner ..... F16J 3/02 415/136
5,584,654 A * 12/1996 Schaefer ..... F01D 9/042 415/190

(Continued)

FOREIGN PATENT DOCUMENTS

JP 2010-270717 A 12/2010
JP 2013-194742 A 9/2013

(Continued)

*Primary Examiner* — Eldon T Brockman
(74) *Attorney, Agent, or Firm* — Invenstone Patent, LLC

(57) ABSTRACT

A turbine stator, into which combustion gas supplied from a combustor of a gas turbine flows, has an improved structure capable of preventing circumferential movement of turbine vanes. The turbine stator, which may be included in a turbine of a gas turbine having the improved structure, includes a casing including first and second casings constituting respective casing halves, the first and second casings having a fastening groove formed on at least one contact surface between the first casing and the second casing; a plurality of vane airfoils configured to be installed on an inner peripheral surface of the casing and arranged in a multi-stage manner in a flow direction of the combustion gas; and a stop configured to be fixed with respect to a vane airfoil of the plurality of vane airfoils and to be inserted into the fastening groove to fix the vane airfoil to the casing.

16 Claims, 6 Drawing Sheets

(56) References Cited

U.S. PATENT DOCUMENTS

| | | | | |
|---|---|---|---|---|
| 9,353,767 | B2 * | 5/2016 | Richardson | F04D 29/644 |
| 9,951,654 | B2 * | 4/2018 | Cortequisse | F01D 9/041 |
| 2005/0042077 | A1 * | 2/2005 | Gekht | F04D 29/164 415/116 |
| 2009/0110552 | A1 * | 4/2009 | Anderson | F01D 5/3053 415/209.3 |
| 2014/0193251 | A1 * | 7/2014 | Richardson | F01D 25/246 415/209.3 |
| 2015/0010395 | A1 * | 1/2015 | Cortequisse | F01D 25/246 415/200 |
| 2017/0089210 | A1 * | 3/2017 | Anand | F02C 7/28 |

FOREIGN PATENT DOCUMENTS

| | | | |
|---|---|---|---|
| JP | 2015-121158 | A | 7/2015 |
| KR | 20-0174662 | Y1 | 4/2000 |

* cited by examiner

[FIG. 1]
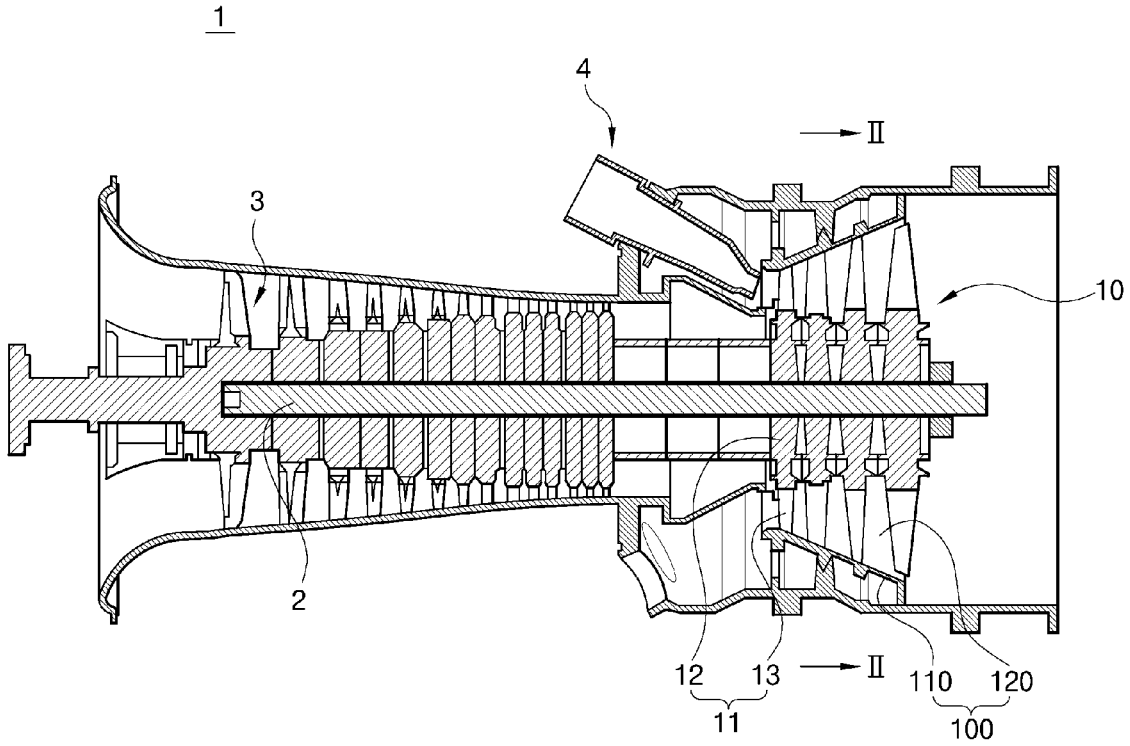

[FIG. 2]
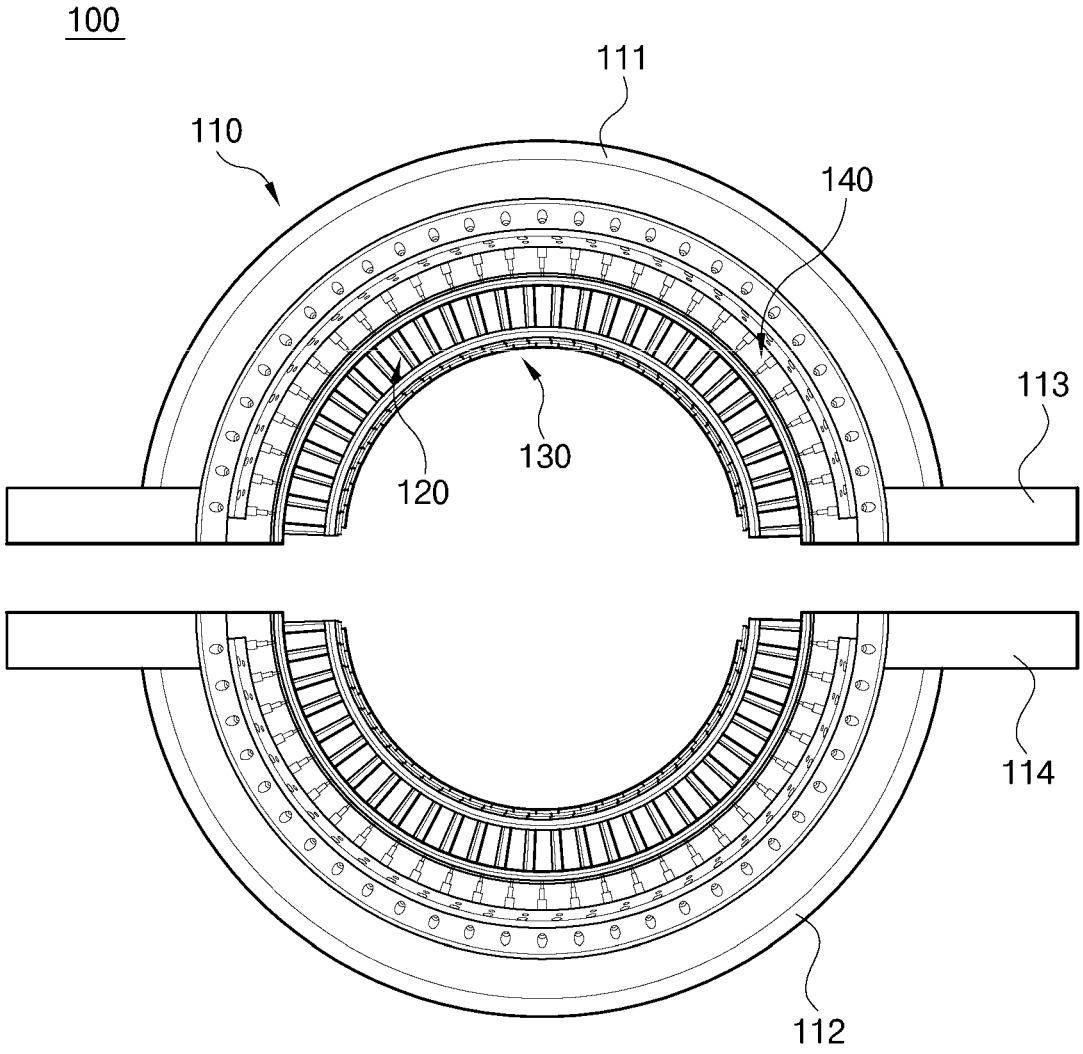

[FIG. 3]
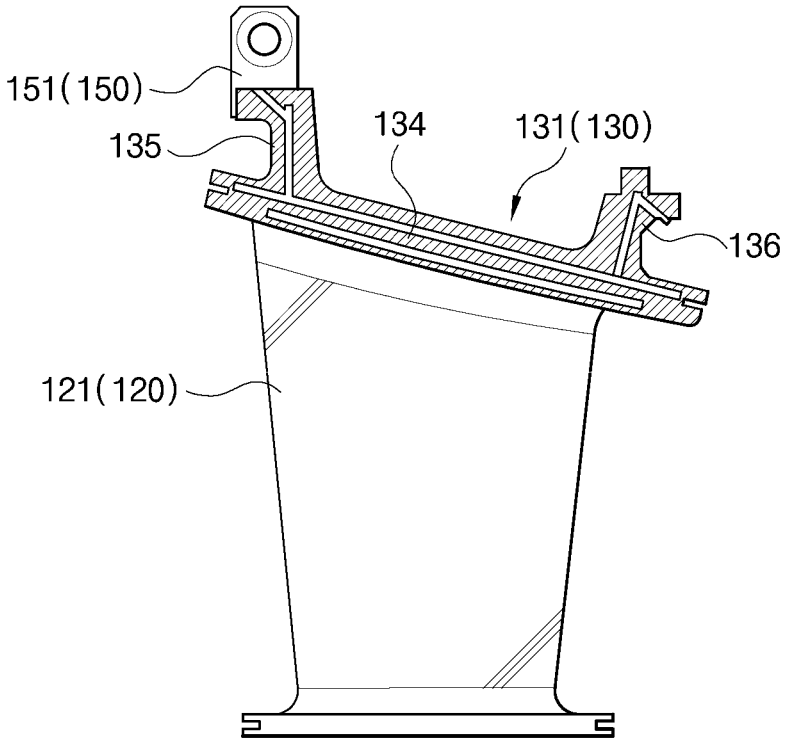

[FIG. 4]
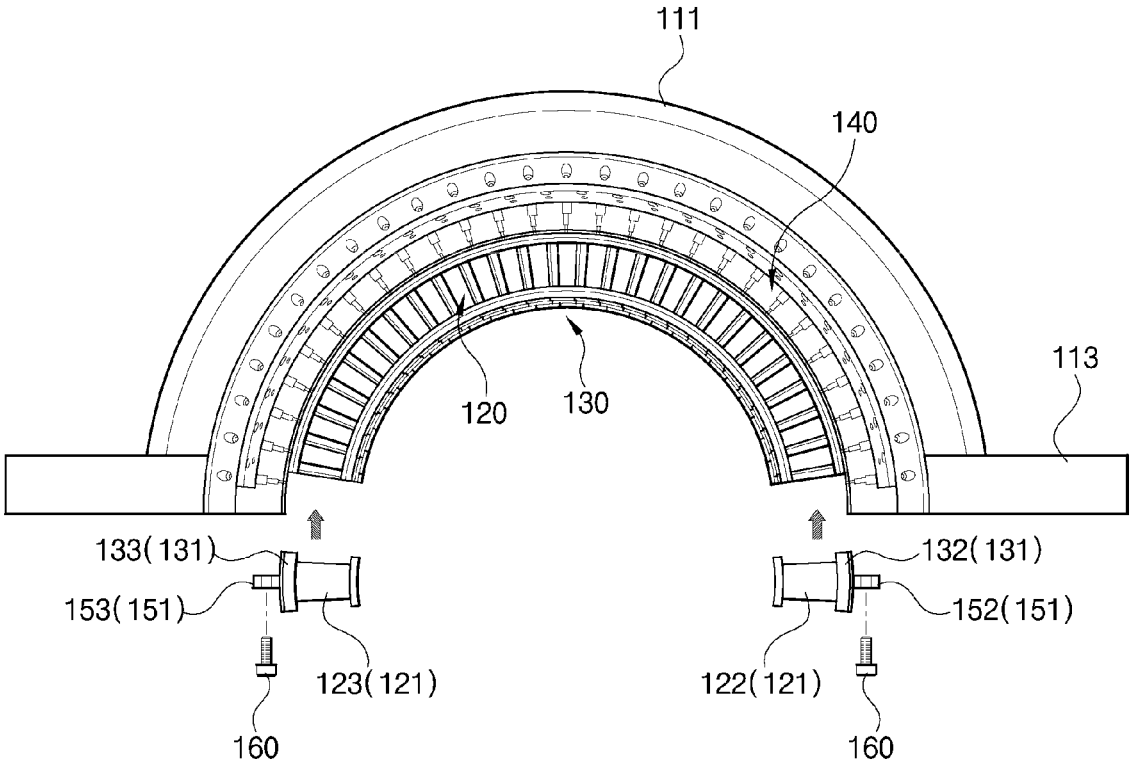

[FIG. 5]
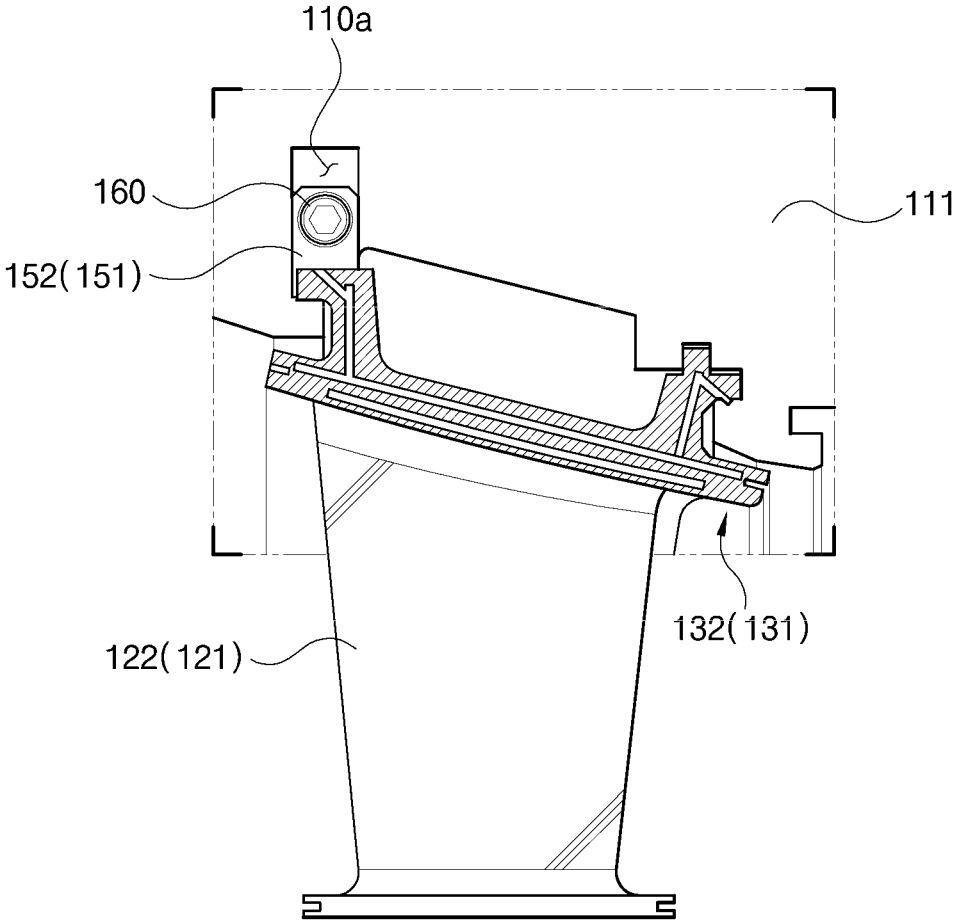

[FIG. 6]
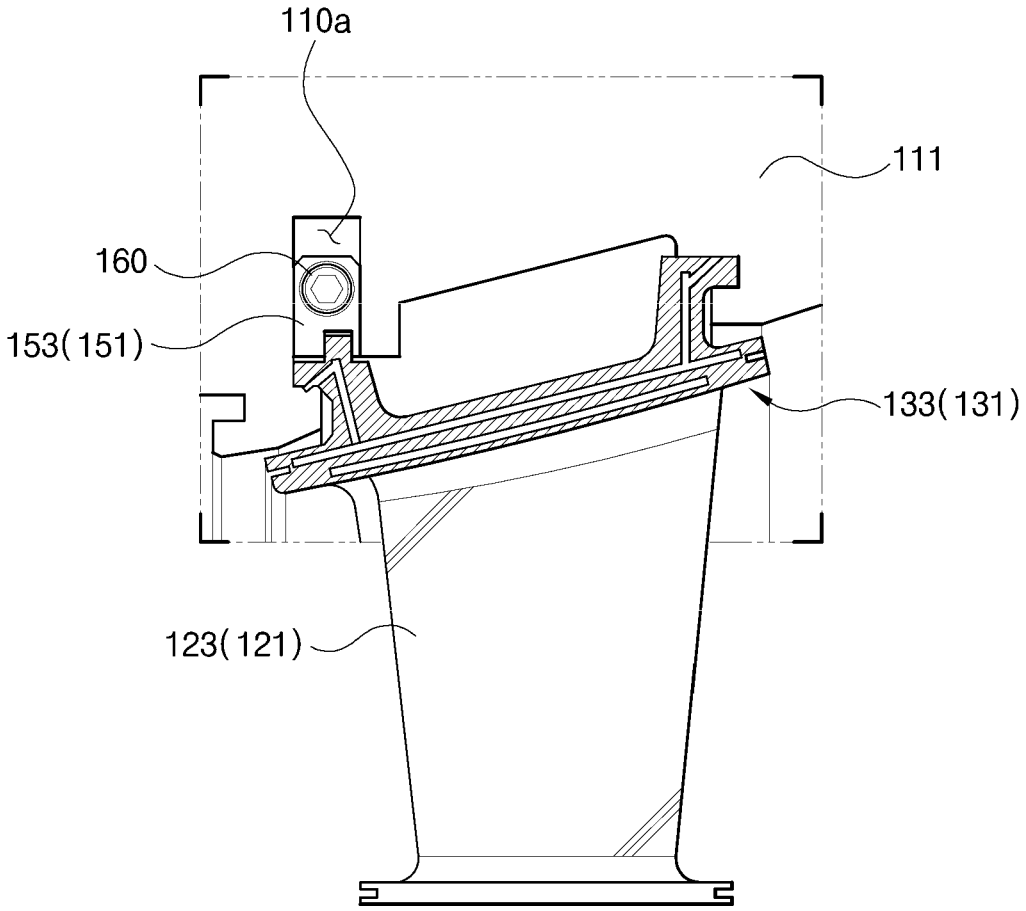

TURBINE STATOR, TURBINE, AND GAS TURBINE INCLUDING THE SAME

CROSS-REFERENCE TO RELATED APPLICATIONS

This application claims priority to Korean Patent Application No. 10-2017-0121199, filed on Sep. 20, 2017, the disclosure of which is incorporated herein by reference in its entirety.

BACKGROUND OF THE INVENTION

Field of the Invention

Exemplary embodiments of the present disclosure relate to a turbine stator, a turbine, and a gas turbine including the same, and more particularly, to a turbine stator into which combustion gas supplied from a combustor flows, a turbine, and a gas turbine including the same.

Description of the Related Art

A gas turbine generally includes a compressor, a combustor, and turbine. The compressor has a compressor inlet scroll strut for the introduction of air, and includes a plurality of compressor vanes and compressor blades alternately arranged in a compressor casing. The combustor mixes fuel with the air compressed by the compressor to ignite the mixture with a burner, thereby producing high-temperature and high-pressure combustion gas.

The turbine includes a plurality of turbine vanes and turbine blades alternately arranged in a turbine casing. A tip clearance is defined as a gap between the turbine casing and each of the turbine blades. In addition, a tie rod is arranged to pass through the centers of the compressor, combustor, turbine and exhaust chamber. The tie rod is rotatably supported at both ends by bearings. A plurality of disks are fixed to the tie rod, and the blades are connected to each of the disks. A drive shaft of a generator or the like is connected to the end of the exhaust chamber.

This gas turbine is advantageous in that it consumes a very small amount of lubricant, has a significantly reduced amplitude which is a characteristic of reciprocating machines, and operates at a high speed because it does not have a reciprocating device such as a piston in a four-stroke engine to have no friction portion between the piston and the cylinder causing deterioration.

Briefly, the gas turbine is operated in such a manner that the air compressed by the compressor is mixed with fuel for combustion to produce hot combustion gas and the produced combustion gas is injected into the turbine. The injected combustion gas generates torque while flowing through the turbine vanes and the turbine blades, thereby rotating a rotor.

Each of the turbine vanes included in the gas turbine includes a turbine vane airfoil and a turbine vane shroud. The turbine vane airfoil is fixed on the inner peripheral surface of the turbine casing by the turbine vane shroud installed between the turbine vane airfoil and the turbine casing.

In this case, the turbine vane has a limitation in that the turbine vane shroud allows the axial movement of the turbine vane to be fixed but cannot provide for its circumferential movement to be fixed. Hence, the gas turbine is problematic in that vibration occurs in the turbine as the turbine vane moves circumferentially, resulting in a reduction in turbine efficiency.

SUMMARY OF THE INVENTION

The present disclosure has been made in view of the above-mentioned problems, and an object thereof is to provide a turbine stator having an improved structure capable of preventing circumferential movement of turbine vanes. The present disclosure has a further object to provide a turbine and a gas turbine including the turbine stator having the improved structure.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a turbine stator into which combustion gas supplied from a combustor flows. The turbine stator may include a casing including first and second casings constituting respective casing halves, the first and second casings having a fastening groove formed on at least one contact surface between the first casing and the second casing; a plurality of vane airfoils configured to be installed on an inner peripheral surface of the casing and arranged in a multi-stage manner in a flow direction of the combustion gas; and a stop configured to be fixed with respect to a vane airfoil of the plurality of vane airfoils and to be inserted into the fastening groove to fix the vane airfoil to the casing.

In accordance with another aspect of the present disclosure, there is provided a turbine to generate power for generation of electric power by passing combustion gas supplied from a combustor. The turbine may include a stator into which combustion gas supplied from the combustor flows, and a rotor installed inside the stator and configured to rotate by the flow of the combustion gas. Here, the stator is consistent with the above turbine stator.

In accordance with another aspect of the present disclosure, a gas turbine may include a compressor to suck and compress air, a combustor to mix compressed air supplied from the compressor with fuel for combustion, and a turbine to generate power for generation of electric power by passing combustion gas supplied from the combustor. Here, the turbine is consistent with the above turbine.

The turbine stator may further include a flange protruding radially outward from either end of an outer peripheral surface of the casing, for coupling together the first and second casings; and a first vane airfoil of the plurality of vane airfoils disposed on an inner peripheral surface of the casing corresponding to a position of the flange.

The turbine stator may further include a plurality of vane shrouds arranged between the casing and the plurality of vane airfoils and configured to be coupled to the plurality of vane airfoils, respectively; and an inner peripheral groove circumferentially formed on the inner peripheral surface of the casing and configured to receive the vane shrouds in order to fix the vane airfoils to the casing.

The turbine stator may further include a first vane shroud of the plurality of vane shrouds coupled to the first vane airfoil, wherein the stop extends outward radially from the first vane shroud.

The turbine stator may further include a plurality of fixing pins inserted inward from an outer peripheral surface of the casing, ends of the fixing pins respectively configured to penetrate, and fix to the casing, only the vane shrouds of the plurality of vane shrouds excluding the first vane shroud.

The first shroud may be fixed to the casing using a force applied in a circumferential direction of the casing, and the vane shrouds of the plurality of vane shrouds excluding the first vane shroud may be fixed to the casing using in a force applied in an axial direction toward the tie rod.

Each vane shroud may include a base plate; a front end protrusion extending outward radially from the base plate so as to be contiguous with a front-stage vane airfoil; and a rear end protrusion extending outward radially from the base plate so as to be contiguous with a rear-stage vane airfoil. The first vane airfoil and the first vane shroud may each be disposed to the right, in the flow direction of the combustion gas, with the stop installed at the front end protrusion of the first vane shroud. Alternatively, the first vane airfoil and the first vane shroud may each be disposed to the left, in the flow direction of the combustion gas, with the stop installed at the front end protrusion of the first vane shroud.

The turbine stator may further include a fastening bolt configured to penetrate the stop in order to fix the stop to the casing.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a cross-sectional view illustrating a schematic structure of a gas turbine to which an embodiment of the present disclosure is applied;

FIG. 2 is a view illustrating a turbine stator that is cut along line "II-II" of FIG. 1;

FIG. 3 is a view illustrating a turbine vane of FIG. 2;

FIG. 4 is a downstream view of the first casing of FIG. 2, illustrating the installation of the first vane airfoil of FIG. 3; and FIGS. 5 and 6 are views of the first vane airfoil of FIG. 3; illustrating the insertion of first right and left stops into a fastening groove.

DESCRIPTION OF SPECIFIC EMBODIMENTS

Reference will now be made in detail to exemplary embodiments of the present disclosure, examples of which are illustrated in the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Hereinafter, a turbine stator, a turbine, and a gas turbine including the same according to exemplary embodiments of the present disclosure will be described with reference to the accompanying drawings.

FIG. 1 illustrates an example of a gas turbine 1 according to the present disclosure. The gas turbine 1 includes a casing and a turbine diffuser disposed behind the casing for discharge of combustion gas having passed through a turbine 10. A combustor 4 is disposed in front of the turbine diffuser for combustion of compressed air supplied from a compressor 3. In terms of airflow direction, the compressor 3 is disposed upstream of the turbine 10.

The casing of the gas turbine 1 includes a compressor casing and a turbine casing 110. The compressor casing accommodates compressor vanes and compressor rotors, and the turbine casing 110 accommodates turbine vanes and turbine rotors 11. A torque tube as a torque transmission member is disposed between the compressor 3 and the turbine 10 to transmit a rotational torque generated in the turbine 10 to the compressor.

Each of the compressor rotors includes a compressor disk and compressor blades. A plurality of compressor disks (e.g., fourteen disks) is accommodated in the compressor casing, and these individual compressor disks are fastened by a tie rod 2 so as not to be axially separated from each other.

In detail, the compressor disks are axially aligned in the state in which the tie rod 2 passes through the substantial centers of the respective compressor disks. Here, the compressor disks are arranged so that the facing surfaces of adjacent compressor disks, pressed together by the tie rod 2, are not rotatable relative to each other.

A plurality of compressor blades are radially coupled to the outer peripheral surface of each compressor disk. A plurality of compressor vanes are fixedly arranged in the compressor casing, alternately with the compressor disks, so as to be respectively disposed between adjacent compressor disks. The compressor vanes are fixed so as not to rotate, unlike the compressor disks, and serve to align the flow of compressed air having passed through upstream compressor blades and to guide the compressed air to compressor blades arranged downstream. In this case, the compressor casing and the compressor vanes may define a comprehensive compressor stator, to distinguish the compressor stator from the compressor rotor.

The tie rod 2 is disposed to pass through the centers of the compressor disks and the turbine disks 12. One end of the tie rod 2 is fastened to a compressor disk positioned at the most upstream side, and the other end is fastened by a fastening nut.

The tie rod 2 is not limited to the structure shown in FIG. 1 and may be variously configured according to the gas turbine 1. That is, one tie rod may pass through the centers of compressor disks and turbine disks (as shown), a plurality of tie rods may be arranged circumferentially, or a combination of these may be used.

Although not illustrated in the drawings, a deswirler serving as a guide vane may be installed in the compressor of the gas turbine in order to adapt the angle of flow of fluid, entering into the inlet of the combustor after the pressure of the fluid is increased, to a design angle of flow.

The combustor mixes the compressed air introduced thereinto with fuel for combustion to produce high-temperature and high-pressure combustion gas with high energy, and increases the temperature of the combustion gas to a temperature at which the combustor and turbine components are able to be resistant to heat in a constant-pressure combustion process.

The constituent combustor of the combustion system of the gas turbine may consist of a plurality of combustors arranged in a combustor casing in the form of a cell, and includes a nozzle for injection of fuel, a liner that forms a combustion chamber, and a transition piece that is a connection between the combustor and the turbine.

In detail, the liner defines a combustion space in which the fuel injected from the fuel nozzle is mixed with the compressed air from the compressor for combustion. The liner may include a combustion chamber as the combustion space in which the fuel mixed with air is burned, and a liner annular passage that defines an annular space while surrounding the combustion chamber. The nozzle for injection of fuel is coupled to the front end of the liner, and an igniter is coupled to the side wall of the liner.

The compressed air, which is introduced through a plurality of holes arranged in the outer wall of the liner, flow in the liner annular passage, and the compressed air used to cool the transition piece, which will be described later, also flows through the liner annular passage. Since the compressed air flows along the outer wall of the liner, it is possible to prevent thermal damage to the liner due to heat generated by combustion of fuel in the combustion chamber.

The transition piece is connected to the rear end of the liner to send the combustion gas burned by an ignition plug to the turbine. Similar to the liner, the transition piece has a transition piece annular passage surrounding the internal space thereof, and the outer wall of the transition piece is cooled by the compressed air flowing along the transition piece annular passage, thereby preventing damage to the transition piece due to the high temperature of combustion gas.

Meanwhile, the high-temperature and high-pressure combustion gas discharged from the combustor is supplied to the turbine. The high-temperature and high-pressure combustion gas supplied to the turbine gives impingement or reaction force to turbine blades while expanding, to generate a rotational torque. The obtained rotational torque is transmitted via the torque tube to the compressor, and the power beyond that for driving the compressor is used to drive a generator or the like.

The turbine 10 basically has a structure similar to the compressor. That is, the turbine 10 includes a plurality of turbine rotors 11 similar to the compressor rotors of the compressor. Thus, each of the turbine rotors 11 similarly includes a turbine disk 12 and a plurality of turbine blades 13 arranged radially. A plurality of turbine vanes fixed to the turbine casing 110 are each arranged between the turbine blades 13 to guide the flow direction of combustion gas having passed through the turbine blades 13. In this case, the turbine casing 110 and the turbine vanes may define a comprehensive turbine stator 100, to distinguish the turbine stator 100 from the turbine rotor 11.

Referring to FIG. 2, the turbine casing 110 (hereinafter referred to as a "casing") includes first and second casings 111 and 112 which constitute the respective halves of casing 110, which are centered about the tie rod 2. As shown, the first casing 111 may constitute the upper portion of the casing 110 and the second casing 112 may constitute the lower portion of the casing 110, but the converse is also possible. That is, the first casing 111 may constitute the lower portion of the casing 110 and the second casing 112 may constitute the upper portion of the casing 110.

The first casing 111 has first flanges 113 protruding radially outward from either end of the casing's outer periphery, for coupling to the second casing 112. The second casing 112 has second flanges 114 protruding radially outward from either end of the casing's periphery, for coupling to the first casing 111. The first and second casings 111 and 112 are fixed to each other, using separate fastening means (not shown) that pass through the first and second flanges 113 and 114 in close contact with each other.

Each of the turbine vanes consists of a turbine vane airfoil 120 (hereinafter referred to as an "airfoil") and a turbine vane shroud 130 (hereinafter referred to as a "shroud"). In FIG. 2, the view is from a front stage looking downstream toward a rear stage. The airfoil 120 serves to guide combustion gas such that the combustion gas having passed through a front-stage turbine blade 13 may be supplied to a rear-stage turbine blade 13. The shroud 130 is disposed between the airfoil 120 and the casing 110 to be coupled to the airfoil 120. The shroud 130 is inserted into an inner peripheral groove circumferentially formed on an inner peripheral surface of the casing 110 and fixes the airfoil 120 to the casing 110.

Here, the shroud 130 is kept fixed in the axial direction of the tie rod 2, but is not fixed in the circumferential direction of the casing 110. If the turbine vane moves circumferentially relative to the casing 110 during the operation of the gas turbine 1, the airfoil 120 may vibrate by impinging against combustion gas flowing in the turbine 10. In this case, the airfoil 120 does not properly guide combustion gas to a next-stage turbine blade 13. Hence, a force applied to the turbine blade 13 is reduced due to expansion of combustion gas, which may lead to a reduction in overall efficiency of the turbine 10.

Accordingly, the stator 100 may further include a fixing pin 140 in order for the shroud 130 and the airfoil 120 coupled thereto to be circumferentially fixed to the casing 110. The fixing pin 140 penetrates inward from the outer peripheral surface of the casing 110, and the end of the fixing pin 140 is inserted into the shroud 130 so that the shroud 130 and the airfoil 120 are fixed to the casing 110. In this case, since the turbine vane is also fixed in the circumferential direction of the casing 110, it is possible to reduce the occurrence of vibration in the turbine 10 and enhance the efficiency of the turbine 10.

As illustrated in FIG. 2, the first flanges 113 and the second flanges 114 are disposed between the first casing 111 and the second casing 112. In this case, due to the presence of the first and second flanges 113 and 114, the fixing pin 140 may not be inserted through the outer peripheral surfaces of the first and second casings 111 and 112 at locations corresponding to the thicknesses of the first and second flanges 113 and 114. Accordingly, as illustrated in FIG. 3, the stator 100 may further include stops 150 to fix to the casing 110 the airfoils 120 that are disposed in correspondence to the positions of the first and second flanges 113 and 114.

Hereinafter, the embodiment of the present disclosure will be described with respect to the first casing 111. However, the embodiment of the present disclosure may be equally applied to the second casing 112 and associated components in the same manner.

Referring to FIGS. 2 and 3, the airfoils 120 may include first vane airfoils 121 (hereinafter referred to as "first airfoils") disposed on the inner peripheral surface of the first casing 111 corresponding to the positions of the respective first flanges 113. In addition, the stops 150 may include first stops 151 provided to the respective first airfoils 121.

In this case, the first stops 151 extend outward radially from first vane shrouds 131 (hereinafter referred to as "first shrouds") coupled to the first airfoils 121, respectively. In more detail, each of the shrouds 130 may further include a base plate 134, a front end protrusion 135 extending outward radially from the base plate 134 so as to be contiguous with a front-stage airfoil, and a rear end protrusion 136 extending outward radially from the base plate 134 so as to be contiguous with a rear-stage airfoil. Each of the first stops 151 is installed at the front or rear end protrusion 135 or 136 of the associated first shroud 131.

Referring to FIGS. 4 to 6, fastening grooves **110*a* are formed on the contact surface of the first casing 111 coming into contact with the second casing 112. The first stops 151** are inserted into the respective fastening groove 110*a* to fix the turbine vanes to the first casing 111. In this case, the stator 100 may further include fastening bolts 160 for fixing the first stops 151 to the first casing 111 by penetrating the first stops 151. That is, the first shrouds 131 are fixed to the first casing 111 by the fastening bolts 160 penetrating the first stops 151 and the first casing 111 from the direction of the second casing 112, instead of by the fixing pins 140 inserted through the outer peripheral surface of the first casing 111. Therefore, the first shrouds 131 are fixed to the first casing 111 using a force applied in the circumferential direction of the first casing 111, and the remainder of the shrouds 130 are fixed to the first casing 111 using in a force applied in the axial direction toward the tie rod 2.

In the case where the first airfoils 121 are fixed to the first casing 111 by the first stops 151 and the fastening bolts 160, it is possible to reduce costs to manufacture products and simplify the structure of the turbine 10 since there is no need for separate fixing pins large enough to penetrate the first flanges 113.

When the flow direction of the combustion gas (or the viewpoint of FIG. 4) is taken as a reference, the first airfoils 121 may include a first right vane airfoil 122 (hereinafter referred to as a "first right airfoil") disposed to the right of the flow direction of the combustion gas, and a first left vane airfoil 123 (hereinafter referred to as a "first left airfoil") disposed to the left of the flow direction of the combustion gas. Similarly, the first shrouds 131 may include a first right vane shroud 132 (hereinafter referred to as a "first right shroud") and a first left vane shroud 133 (hereinafter referred to as a "first left shroud").

In addition, the first stops 151 may include a first right stop 152 installed at the front end protrusion 135 of the first right shroud 132, and a first left stop 153 installed at the rear end protrusion 136 of the first left shroud 133. That is, the first right stop 152 is installed adjacent to the front-stage turbine vane and the first left stop 153 is installed adjacent to the rear-stage turbine vane.

Although not illustrated in the drawing, among the stops 150 fixed to the second casing 112, the stop 150 installed at the airfoil 120 facing the first right airfoil 122 may be installed adjacent to the rear-stage turbine vane, and the stop 150 installed at the airfoil 120 facing the first left airfoil 123 may be installed adjacent to the front-stage turbine vane.

In this case, a pair of stops 150 is provided at each of front and rear end sides on the contact surface between the first casing 111 and the second casing 112 with respect to the same stage. Thus, in the turbine stator 100, the turbine 10, and the gas turbine 1 including the same according to the present disclosure, when the first casing 111 is coupled to the second casing 112, it is possible to prevent impingement between the stops 150 and fastening bolts 160 fixed to the first casing 111 and the stops 150 and fastening bolts 160 fixed to the second casing 112.

As described above, in accordance with the turbine stator 100, the turbine 10, and the gas turbine 1 including the same of the present disclosure, it is possible to reduce occurrence of vibration in the turbine 10 and enhance the efficiency of the turbine 10 since the turbine vanes are circumferentially fixed. In addition, in accordance with the turbine stator 100, the turbine 10, and the gas turbine 1 including the same of the present disclosure, it is possible to simplify the structure of the turbine 10 and reduce costs incurred by using separate fixing pins since the turbine vanes positioned inside the flanges 113 and 114 are fixed to the casing by means of the stops 150.

While the present disclosure has been described with respect to the embodiments illustrated in the drawings, it will be obvious to those skilled in the art that such embodiments are provided by way of example only. It will be understood by those skilled in the art that various modifications and other equivalent embodiments may be made without departing from the spirit and scope of the disclosure as defined in the following claims. Therefore, the true technical protection scope of the present disclosure should be defined by technical concepts of the appended claims.

What is claimed is:

1. A turbine stator into which combustion gas supplied from a combustor flows, the turbine stator comprising:

a casing including first and second casings constituting respective casing halves, the casing having a contact surface between the first and second casings, and a fastening groove formed on at least one contact surface of the first casings and the second casings, the fastening groove having an elongated shape extending radially with respect to the casing in a longitudinal direction of the fastening groove;

a plurality of vane airfoils configured to be installed on an inner peripheral surface of the casing and arranged in a multi-stage manner in a flow direction of the combustion gas;

a plurality of vane shrouds arranged between the casing and the plurality of vane airfoils and configured to be coupled to the plurality of vane airfoils, respectively;

an inner peripheral groove circumferentially formed on the inner peripheral surface of the casing and configured to receive the vane shrouds in order to fix the vane airfoils to the casing;

a first vane shroud of the plurality of vane shrouds coupled to a first vane airfoil of the plurality of vane airfoils; and a stop that extends outward radially from one end of the first vane shroud and is configured to be fixed with respect to a vane airfoil of the plurality of vane airfoils and to be inserted into the elongated shape of the fastening groove to fix the vane airfoil to the casing.

2. The turbine stator according to claim 1, further comprising:

a flange protruding radially outward from either end of an outer peripheral surface of the casing, for coupling together the first and second casings, wherein the first vane airfoil is disposed on an inner peripheral surface of the casing corresponding to a position of the flange.

3. The turbine stator according to claim 1, further comprising:

a plurality of fixing pins inserted inward from an outer peripheral surface of the casing, ends of the fixing pins respectively configured to penetrate, and fix to the casing, only the vane shrouds of the plurality of vane shrouds excluding the first vane shroud.

4. The turbine stator according to claim 1, wherein the first shroud is fixed to the casing using a force applied in a circumferential direction of the casing, and the vane shrouds of the plurality of vane shrouds excluding the first vane shroud are fixed to the casing.

5. The turbine stator according to claim 1, wherein each vane shroud comprises:

a base plate;

a front end protrusion extending outward radially from the base plate so as to be contiguous with a front-stage vane airfoil; and a rear end protrusion extending outward radially from the base plate so as to be contiguous with a rear-stage vane airfoil.

6. The turbine stator according to claim 5, wherein the stop is installed at the front end protrusion of the first vane shroud.

7. The turbine stator according to claim 5, wherein the stop is installed at the rear end protrusion of the first vane shroud.

8. The turbine stator according to claim 1, further comprising a fastening bolt penetrating the stop to fix the stop to the casing.

9. A turbine to generate power for generation of electric power by passing combustion gas supplied from a combustor, the turbine comprising:

a stator into which combustion gas supplied from the combustor flows, and a rotor installed inside the stator and configured to rotate by the flow of the combustion gas, wherein the stator comprises:

a casing including first and second casings constituting respective casing halves, the casing having a contact surface between the first and second casings, and a fastening groove formed on at least one contact surface of the first casings and the second casings, the fastening groove having an elongated shape extending radially with respect to the casing in a longitudinal direction of the fastening groove;

a plurality of vane airfoils configured to be installed on an inner peripheral surface of the casing and arranged in a multi-stage manner in a flow direction of the combustion gas;

a plurality of vane shrouds arranged between the casing and the plurality of vane airfoils and configured to be coupled to the plurality of vane airfoils, respectively;

an inner peripheral groove circumferentially formed on the inner peripheral surface of the casing and configured to receive the vane shrouds in order to fix the vane airfoils to the casing;

a first vane shroud of the plurality of vane shrouds coupled to a first vane airfoil of the plurality of vane airfoils; and a stop that extends outward radially from one end of the first vane shroud and is configured to be fixed with respect to a vane airfoil of the plurality of vane airfoils and to be inserted into the elongated shape of the fastening groove to fix the vane airfoil to the casing.

10. The turbine according to claim 9, further comprising:

a flange protruding radially outward from either end of an outer peripheral surface of the casing, for coupling together the first and second casings, wherein the first vane airfoil is disposed on an inner peripheral surface of the casing corresponding to a position of the flange.

11. The turbine according to claim 9, further comprising:

a plurality of fixing pins inserted inward from an outer peripheral surface of the casing, ends of the fixing pins respectively configured to penetrate, and fix to the casing, only the vane shrouds of the plurality of vane shrouds excluding the first vane shroud.

12. The turbine according to claim 9, wherein the first shroud is fixed to the casing using a force applied in a circumferential direction of the casing, and the vane shrouds of the plurality of vane shrouds excluding the first vane shroud are fixed to the casing.

13. The turbine according to claim 9, wherein each vane shroud comprises:

a base plate;

a front end protrusion extending outward radially from the base plate so as to be contiguous with a front-stage vane airfoil; and a rear end protrusion extending outward radially from the base plate so as to be contiguous with a rear-stage vane airfoil.

14. The turbine according to claim 13, wherein the stop is installed at the front end protrusion of the first vane shroud.

15. The turbine according to claim 13, wherein the stop is installed at the rear end protrusion of the first vane shroud.

16. A gas turbine comprising a compressor to suck and compress air, a combustor to mix compressed air supplied from the compressor with fuel for combustion, and a turbine to generate power for generation of electric power by passing combustion gas supplied from the combustor, wherein the turbine comprises a stator into which combustion gas supplied from the combustor flows, and a rotor installed inside the stator and configured to rotate by the flow of the combustion gas, and wherein the stator comprises:

a casing including first and second casings constituting respective casing halves, the casing having a contact surface between the first and second casings, and a fastening groove formed on at least one contact surface of the first casings and the second casings, the fastening groove having an elongated shape extending radially with respect to the casing in a longitudinal direction of the fastening groove;

a plurality of vane airfoils configured to be installed on an inner peripheral surface of the casing and arranged in a multi-stage manner in a flow direction of the combustion gas;

a plurality of vane shrouds arranged between the casing and the plurality of vane airfoils and configured to be coupled to the plurality of vane airfoils, respectively;

an inner peripheral groove circumferentially formed on the inner peripheral surface of the casing and configured to receive the vane shrouds in order to fix the vane airfoils to the casing;

a first vane shroud of the plurality of vane shrouds coupled to a first vane airfoil of the plurality of vane airfoils; and a stop that extends outward radially from one end of the first vane shroud and is configured to be fixed with respect to a vane airfoil of the plurality of vane airfoils and to be inserted into the elongated shape of the fastening groove to fix the vane airfoil to the casing.

* * * * *